United States Patent [19]

Gunderson

[11] Patent Number: 4,780,026

[45] Date of Patent: Oct. 25, 1988

[54] TENSION LEG PLATFORM AND INSTALLATION METHOD THEREFOR

[75] Inventor: Richard H. Gunderson, Houston, Tex.

[73] Assignee: Exxon Production Research Company, Houston, Tex.

[21] Appl. No.: 32,901

[22] Filed: Mar. 31, 1987

[51] Int. Cl.[4] ..... B63B 21/50

[52] U.S. Cl. ..... 405/224; 114/297; 405/195

[58] Field of Search ..... 405/224, 225, 195, 202, 405/169; 114/264, 294, 297; 403/326; 285/307; 166/350, 338, 341

[56] References Cited

U.S. PATENT DOCUMENTS

| | | | |
|---|---|---|---|
| 4,281,613 | 8/1981 | Ray et al. | 114/230 |
| 4,320,993 | 3/1982 | Hunter | 405/224 |
| 4,459,933 | 7/1984 | Burchett | 405/224 X |
| 4,468,157 | 8/1984 | Horton | 405/224 |
| 4,491,439 | 1/1985 | Watkins | 405/195 X |
| 4,516,882 | 5/1985 | Brewer et al. | 405/224 |
| 4,611,953 | 9/1986 | Owens | 405/224 |

OTHER PUBLICATIONS

"New Tethering Method Key to TLP Design", no author named, Ocean Engineering, Mar. 1987, pp. 22–23.

Tension Goes On at World's First Tension Leg Platform, Offshore Engineer, Aug. 1984, pp. 26–29.

*Primary Examiner*—Dennis L. Taylor
*Attorney, Agent, or Firm*—Richard F. Phillips

[57] ABSTRACT

A tether and tether tensioning system for a tension leg platform. A plurality of elongate tethers 12 are used to secure a tension leg platform hull 20 to a foundation 14 at the ocean floor. Each tether 12 has a lower end secured to the ocean floor foundation 14. The tethers 12 extend upward to a position slightly below the bottom of the hull 20. A tether securing and tensioning system 30 is positioned within the hull 20 for each tether 12. This system includes a tether extender 22 positioned within a shroud 28 in the hull bottom. The tether extender 22 includes a tether latch 24 at its lower end. The tensioning system is adapted to lower the tether extender 22 downward below the hull 20 to permit the tether extender 22 to latch to the tether 12. The securing and tensioning system 30 then raises the tether extender 22 to tension the tether 12. The tether tensioning system of the present invention permits use of a simplified method for installing TLPs. The tethers 12 extend upward to an elevation which, at least initially, is below the maximum draft of the tension leg platform hull 20. This permits the tethers to be installed offshore prior to installation of the hull 20. Following tether installation the hull 20 is floated to a position directly above the tethers 12 and the tether securing and tensioning system is used to lock the hull 20 to the tethers.

25 Claims, 5 Drawing Sheets

TENSION LEG PLATFORM AND INSTALLATION METHOD THEREFOR

TECHNICAL FIELD

The present invention relates generally to offshore structures. More specifically, the present invention concerns a tension leg platform employing preinstalled tethers.

BACKGROUND OF THE INVENTION

In recent years, the search for offshore oil and gas reserves has been carried into water depths considerably deeper than those from which most oil and gas production has been conducted to date. Producing oil and gas from reservoirs in deep water regions presents a host of technical problems. One of the most challenging of these has been the development of deep water platforms from which drilling and production activities can be conducted. Most current drilling and production of offshore hydrocarbons is conducted from platforms consisting of a work deck supported above the ocean surface by a rigid concrete or tubular steel structure which is rigidly secured to the ocean bottom. Such platforms are well suited for a water depths of up to 250–350 meters. As water depths exceed this, it becomes increasingly difficult and expensive to produce a structure which will rigidly resist the wave, wind and current loadings to which it will be exposed. It is generally considered economically impractical to use rigid structures for oil and gas production in water depths beyond about 400 meters.

To avoid the strong depth sensitivities of conventional rigid offshore drilling and production structures a number of alternate structures have been proposed. One such alternate structure is the tension leg platform (TLP). The general configuration of a TLP is illustrated in FIG. 1 of the appended drawings. A TLP has a buoyant hull supporting a work deck from which drilling and producing activities are conducted. The hull is moored to a foundation on the ocean bottom by a set of elongate tethers which are secured to the buoyant hull under tension. The tensioned tethers maintain the hull at a significantly greater draft than it would assume if free floating. The balance of forces imposed by buoyancy and the tensioned tethers limits the degree to which the TLP undergoes motion in response to forces imposed by waves, ocean currents and wind. It has been suggested that TLPs could be employed in water depths up to 3000 meters, whereas the deepest present application of a conventional rigid offshore drilling and production structure is in a water depth of approximately 410 meters.

Though TLPs avoid many of the disadvantages faced by conventional platforms in deep water, they do present their own special problems. One area of TLP design and operation that has proven especially troublesome concerns the system for installing and tensioning the tethers. In most TLP designs proposed to date the tethers are installed by lowering them to the ocean floor through the columns of the TLP itself. To enable this, the tethers are made up of threaded tubular segments which are secured together section by section as the tether is lowered. This arrangement presents a number of problems. The TLP must be provided with heavy hoisting equipment to support the great weight of the tether as it is lowered or raised. Additionally, the entire length of the columns of the TLP must be reserved for the tethers which pass therethrough. This space could otherwise be used for other purposes, such as housing drilling and production equipment. Further, through column tether installation is very time consuming. This increases the vulnerability of the TLP to adverse weather during the installation process.

It would be desirable to develop a TLP which avoids the need for through column tether installation.

SUMMARY OF THE INVENTION

An apparatus is set forth which is useful in connecting the tethers of a tension leg platform (TLP) to the TLP hull and subsequently tensioning the tethers. The present invention is based on the use of tethers which extend upward from a foundation at the ocean floor to a position which, at least initially, is a short distance below the bottom of the TLP hull. The TLP hull is provided with a tether securing and tensioning system corresponding to each tether. In the preferred embodiment, each tether securing and tensioning system extends downward through a recess in the bottom of the TLP hull to grasp the upper end of the corresponding tether. The tether is then tensioned either by pulling it upward relative to the hull or by deballasting the hull to cause it to assume a shallower draft. In either case the tensioned tether forces the hull to maintain a deeper draft than would occur were the hull unrestrained. The buoyant force of the hull maintains the tethers in tension. The tensioned tethers moor the hull above the foundation, restraining it against excessive heave, pitch and roll motion in response to waves, wind and ocean currents.

Also set forth is a method for TLP installation based on the use of tethers which extend upward from an ocean floor foundation to a position a short distance below the TLP hull. Prior to towing the TLP hull to the installation site, the tethers are preinstalled on the foundation. Buoyancy collars are secured to the upper end of each tether to maintain the tethers upright. The TLP hull is then towed to a position above the upper ends of the tethers. In the preferred embodiment, a tether extender is then lowered downward from within the hull and is latched to each of the tethers. The tether extenders bridge the vertical gap between the hull and the tethers. After being latched to the tether, the tether extender is biased upward, placing the tether in tension.

BRIEF DESCRIPTION OF THE DRAWINGS

For a better understanding of the present invention reference may be had to the accompanying drawings in which.

These drawings are not intended as a definition of the invention, but are provided solely for the purpose of illustrating preferred concepts of the invention.

DESCRIPTION OF THE PREFERRED EMBODIMENT

Introduction

The present invention concerns a tension leg platform (TLP) incorporating a novel system for securing and tensioning the hull of the TLP to a set of tethers extending upward from a foundation at the ocean floor. In another aspect, the present invention concerns a TLP installation method using preinstalled tethers.

Figure 1:
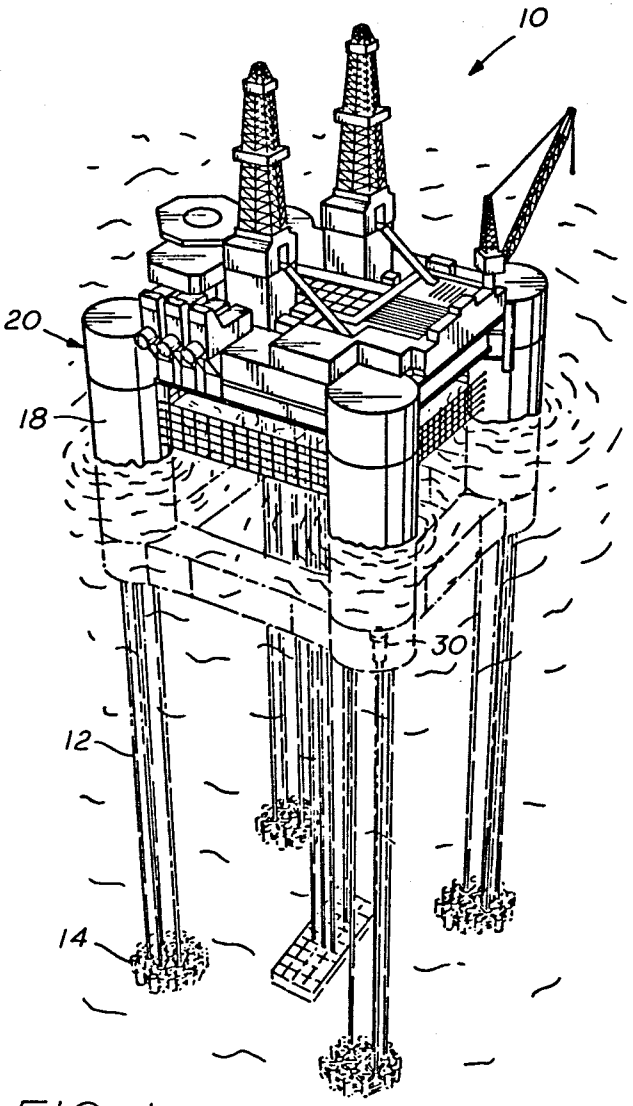
FIG. 1 shows an elevational view of a tension leg platform incorporating the tether securing and tensioning system of the present invention.

Shown in FIG. 1 is a TLP 10 incorporating a preferred embodiment of the present invention. A plurality of tethers 12 extend upward from a foundation 14 at the ocean floor to a position immediately below the columns 18 of the buoyant TLP hull 20. The tethers 12 are arranged in sets, each set corresponding to a single column 18. The tethers 12 are each secured to a corresponding column 18 by a tether extender 22, which serves to bridge the gap between the column 18 and the upper end of the tether 12. The tether extenders 22 each have a lower end provided with a latch 24 for releaseably securing the tether extender 22 to the upper end of the tether 12. The upper end of the tether extender 22 projects into the column 18. Means 26 are provided within the column 18 for biasing the tether extender 22 upward relative to the TLP hull 20 once the tether extender 22 is secured to the tether 12. This causes the hull 20 to assume a deeper draft than would be the case were it floating free. The resulting buoyant force of the hull 20 maintains the tethers 12 under tension. The tensioned tethers 12 greatly limit the response of the hull 20 to waves, ocean currents and wind.

The tether extenders 22 and tether extender biasing means 26 together form a tether securing and tensioning system 30. This tether securing and tensioning system 30 permits the use of tethers 12 which extend upward from the ocean floor to a position below the bottom of the hull 20. Leaving vertical clearance between the tethers 12 and the hull 20 greatly simplifies TLP installation. The tethers 12 can be preinstalled in the foundation 14 prior to completion of the hull 20. Upon completion, the hull 20 is towed directly over the preinstalled tethers 12 and then secured thereto by the securing and tensioning system 30. This yields a much quicker and simpler installation than is possible with conventional through-the-column tether installation. Further, by avoiding a through-the-column tether system the TLP 10 does not require heavy tether hoisting equipment and the columns 18 do not have to accommodate the passage of tethers along their entire length. This reduces the total load which the TLP hull 20 must support and frees the columns for drilling and producing equipment. The specific apparatus and method of the preferred embodiment of the present invention will now be described in detail.

Tether Securing and Tensioning System

Figure 2:
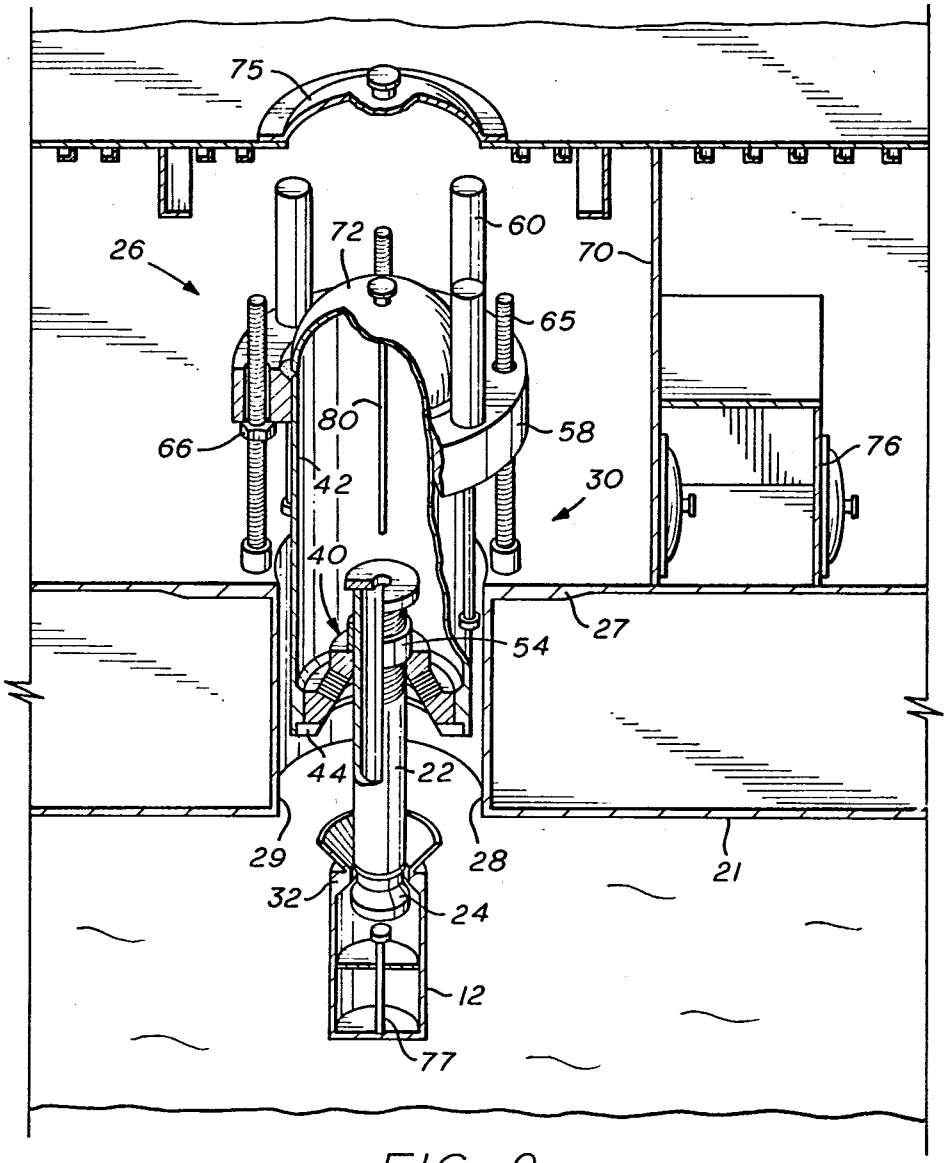
FIG. 2 shows a simplified diagrammatic perspective view of a prefered embodiment of the tether securing and tensioning system of the present invention, half of the load studs have been omitted from this view in the interest of clarity.
Figure 3:
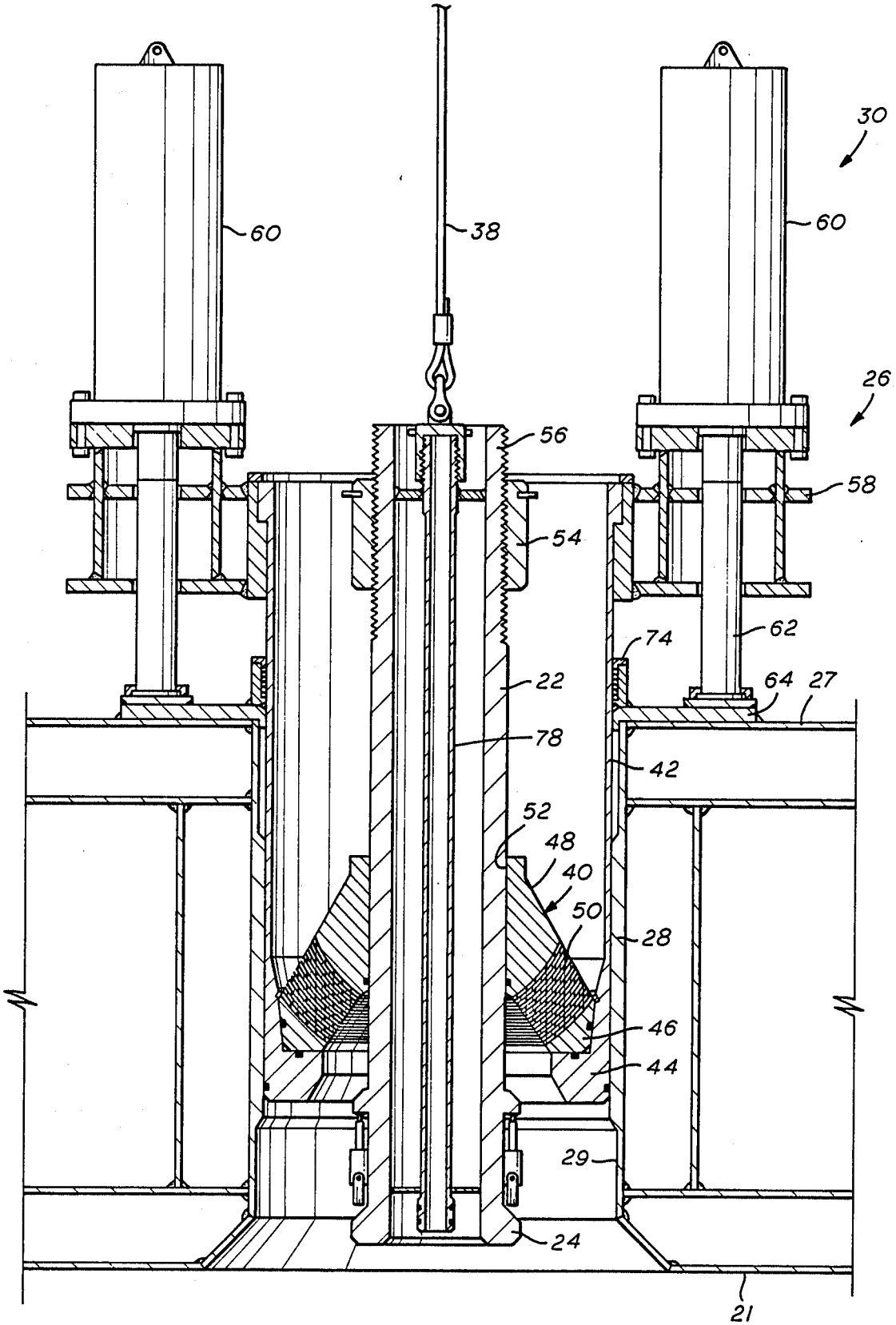
FIG. 3 is a detailed view in elevational cross section of a preferred embodiment of the tether securing and tensioning system.
Figure 4:
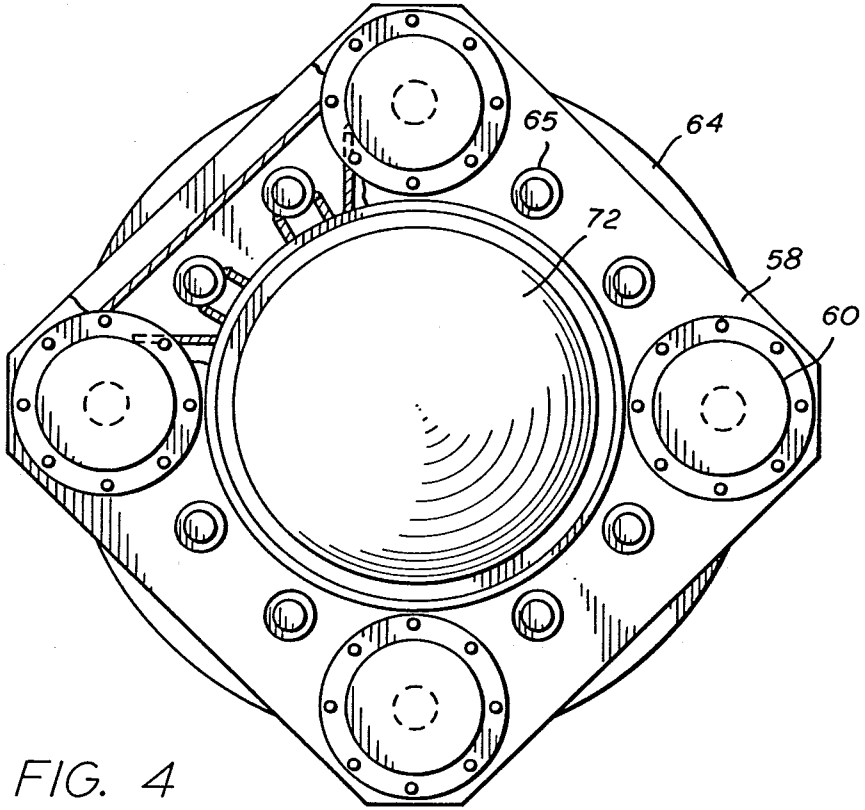
FIG. 4 is a plan view corresponding to FIG. 3.

Shown in FIG. 2 is a simplified, perspective view of a preferred embodiment of the tether securing and tensioning system 30 forming one aspect of the present invention. FIGS. 3 and 4 give detailed elevational and plan views, respectively, corresponding generally to FIG. 2. As shown in these figures, a mooring deck 27 is situated within each column 18 of the hull 20 a spaced distance above the column bottom 21. Extending between the column bottom 21 and the mooring deck 27 are a number of tether extender shrouds 28. Each shroud 28 defines a recess 29 in the bottom of the hull 20 through which one of the tether securing and tensioning systems 30 operates to interface with the corresponding tether 12.

Figure 5:
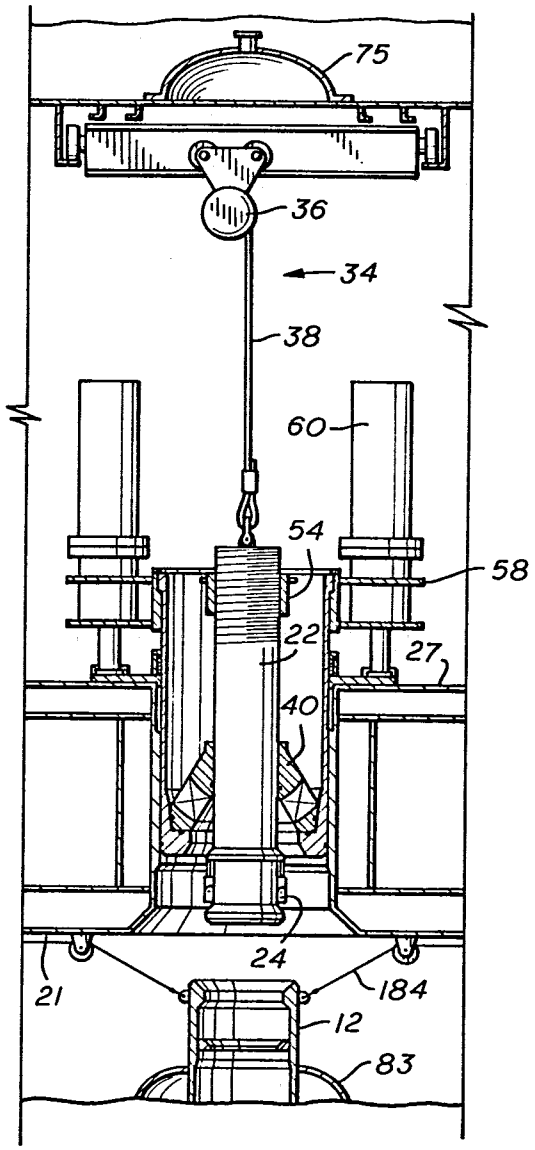
FIG. 5 is a simplified view corresponding generally to FIG. 3 illustrating the hoisting equipment used in raising and lowering the tether extension element.

A tether extender 22 is positioned within each tether extender shroud 28. The lower end of the tether extender 22 is provided with a latch element 24 which is adapted to be secured to a corresponding latch element 32 at the upper end of the tether 12. Means 34 are provided for raising and lowering the tether extender 22 between an upper position, in which the extender latch element 24 is within the tether extender shroud 28, and a lower position in which the extender latch element 24 projects downward from the tether extender shroud 28. The raising and lowering means 34 preferably includes a hoist 36 and cable 38 assembly, as illustrated in FIG. 5.

The tether extender 22 is supported within the tether extender shroud 28 by a flex bearing 40 and a flex bearing adapter 42. The flex bearing adapter 42 is a generally tubular member having an outside diameter very slightly smaller than the inside diameter of the tether extender shroud 28. As detailed more fully below, the flex bearing adapter 42 is adapted to be controllably moved upward and downward as part of the tether extender biasing means 26 to permit adjustment of the tension applied to the tether 12. The flex bearing adapter 42 has an internal flange 44 at its lower end on which the flex bearing 40 is supported. The flex bearing 40 has a lower annular member 46 which is secured to the support flange 44, an upper annular member 48, and a thickness of laminated elastomeric material 50 sandwiched between the upper and lower bearing members 46, 48, The upper annular member 48 defines a bore 52 through which the lether extender 22 passes. The purpose of the flex bearing 40 is to permit the tether extender 22 to pivot relative to the TLP hull 20. This is necessary to accommodate the motion of the hull 20 which occurs in the course of normal operation of the TLP 10. In a typical embodiment, the flex bearing 40 must permit the tether extender 22 to tilt a maximum of about 10° relative to the axis of the tether extender shroud 28.

The flex element bore 52 is slightly larger than the outside diameter of the tether extender 22. This permits the tether extender 22 to be freely moved in the vertical direction through the flex bearing 40 by the raising and lowering means 34 in the course of securing and releasing the lether 12. Loads are transferred from the tether extender 22 to the flex bearing 40 through a threaded load ring 54 on an upper threaded segment 56 of the tether extender 22. As an initial step in the installation procedure, the threaded load ring 54 is adjusted upward or downward on the tether extender 22 to the appropriate axial position such that when the tether extender 22 is lowered to cause the load ring 54 to rest upon the flex bearing 40, the tether extender 22 extends downward the correct distance to permit it to be mated with the tether 12.

A crosshead 58 is rigidly secured to the upper end of the flex bearing adapter 42. The crosshead 58 is used to raise and lower the flex bearing adapter 42 once the tether extender 22 is secured to the tether 12, to apply and adjust the tether tension. A plurality of hydraulic tensioning cylinders 60 are secured to the crosshead 58 with their piston rods 62 extending downward to a load plate 64 on the mooring deck 27. After the tether extender 22 is latched to the tether 12, the tensioning cylinders 60 can be activated to drive the crosshead 58 upward until the desired tether tension is achieved.

Figure 6:
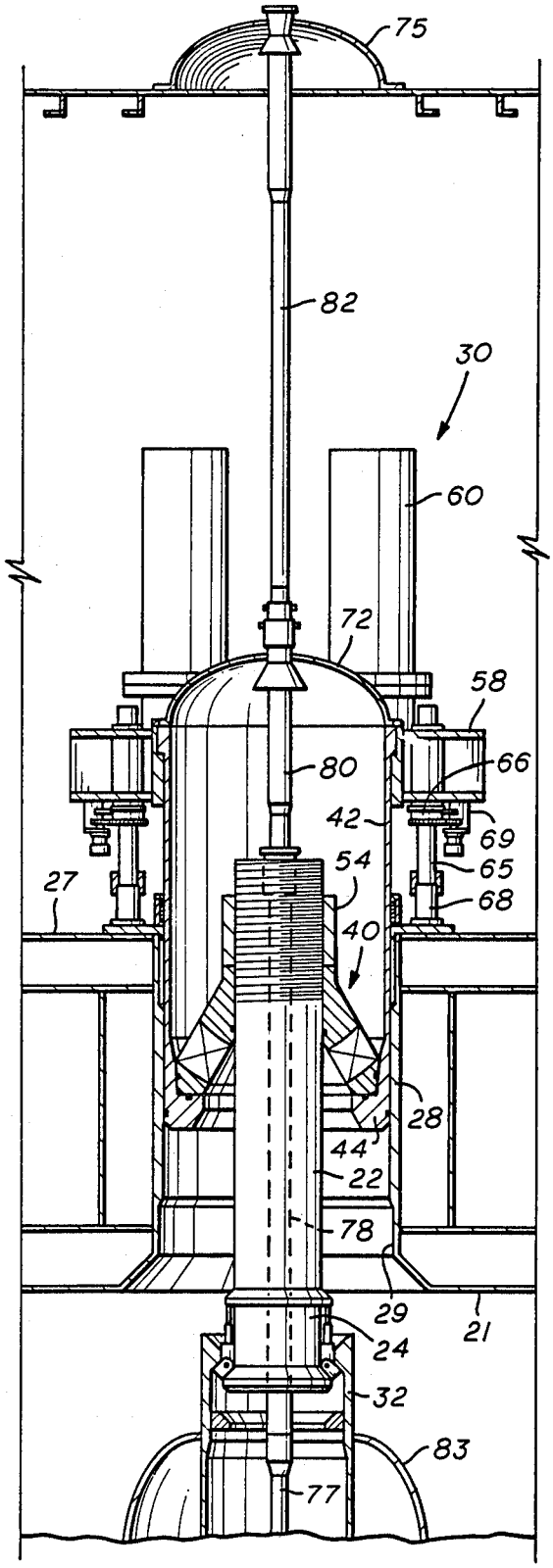
FIG. 6 is a view in elevational cross section generally corresponding to FIG. 3 but also showing details of the tether latch and the central access tube extension.

A plurality of load studs 65 are provided to lock the crosshead 58 at a fixed elevation relative to the mooring deck 27 once the tether 22 is tensioned. The load studs 65 are best shown in FIG. 6. The upper portion of each load stud 65 is threaded and extends through a load nut 66 secured to the crosshead 58. The lower portion of each load stud 65 is normally supported on the load plate 64 through a load ceil 68. As the crosshead 58 is driven upward by the tensioning cylinders 60 the load studs 65 and load cells 68 move upward from the mooring deck 27. When the crosshead 58 reaches its final position, the load studs 65 are lowered to the load plate 64 by rotating the load nuts 66 with a hydraulic drive 69 secured to the bottom of the crosshead 58. The hydraulic pressure applied to the tensioning cylinders 60 then relieved, transferring the load of the tether 12 to the load studs 65. The load cells 68 are used to monitor tether tension during operation of the TLP.

The region of each column 18 in which the tether securing and tensioning systems 30 are located is maintained as a water-free work chamber 70. Three primary seals prevent seawater from entering the work chamber 70. These are O-rings situated in machined grooves at the interfaces of: (1) the tether extender shroud 28 and the flex bearing adapter 42; (2) the flex bearing 40 and the flex bearing adapter 42; and (3) the flex bearing 40 and the tether extending 22. As shown in FIG. 6, an elliptical head 72 is secured to the top of the flex bearing adapter 42 to establish a backup for the two primary seals on the flex element 42. Thus, if leakage occurs past the flex element 42, the seawater will be contained within the flex bearing adapter 42 and will not enter the work chamber 70. A stuffing box seal 74 is provided where the flex bearing adapter 42 passes through the load plate 64 as a backup seal to prevent leakage between the flex bearing adapter 42 and the tether extender shroud 28.

As shown in FIG. 2, each work chamber 70 is adapted to be maintained as a pressurized work area. Pressurization of the work chamber 70 may be necessary during certain phases of tether installation, as detailed below. A sealable hatch 75 is provided directly above the tether extender shroud 28 to permit portions of the tether securing and tensioning system 30 to be removed from and returned to the work chamber 70 for ease of repair and maintenance. An air lock 76 is provided to permit entry into the work chamber 70 when it is pressurized.

It is anticipated that the tether 12 used in conjunction with the present tether securing and tensioning system 30 will have a central access tube 77 extending from the top to the bottom of the tether 12. The central access tube 77 provides a pathway for tools used in the periodic inspection of the tether 12. A preferred system for adapting the tether securing and tensioning system 30 to accommodate the central access tube 77 is illustrated in FIG. 6. A central access tube extender 78 is rigidly secured within the tether extender 22. The central access tube extender 78 mates with the tether central access tube 77 at a slip joint as the tether extender 22 is inserted into and secured to the tether 12. A first removable access tube segment 80 extends between the tether extender 22 and the elliptical head 72. This segment 80 must be flexible since the tether extender 22 pivots relative to the TLP hull 20. A second removable access tube segment 82 extends between the elliptical head 72 and the sealable hatch 75 at the top of the work chamber 70.

TLP Installation and Operation of the Tensioning System

The tether securing and tensioning system 30 detailed above permits use of a considerably less complex installation procedure than is necessary with a TLP employing a conventional through-the-column tether system. The initial step in installation of the present TLP 10 is to establish a tether foundation 14 at the ocean floor. This is preferably accomplished using piled foundation templates, as illustrated in FIG. 1. The tethers 12 are secured to the foundation 14 prior to the hull 20 being brought on-site. The tether installation can in fact be performed while the hull 20 is under construction, thus removing tether fabrication and installation from the critical scheduling path for construction. The foundation 14 is provided with latch elements (not shown) which are adapted to permit the tethers 12 to be remotely attached to and removed from the foundation 14.

It is anticipated that initial tether installation will be accomplished using one of two basic methods. In one method each tether 14 is assembled from individual threaded tubular elements. The tether elements are transported to the installation site on a work barge. At the installation site, the tethers are assembled and lowered to the foundation in a vertical orientation. The tethers have a net negative buoyancy but are provided with a buoyancy collar 83 at their upper end to maintain the tether 12 upright after it is secured to the foundation 14 and released from the work barge. The lower end of the tether 12 is provided with a latch element which mates with a corresponding latch element secured to the foundation. An ROV is used to assist in securing the tether to the foundation. Once all the tethers are preinstalled, they may be left unattended until completion of the TLP hull 20.

In the alternate method of tether installation, the tethers 12 are assembled to their final configuration at a shore-based construction site. They are then towed in a horizontal buoyant condition to the installation site. If the tether 12 does not have sufficient inherent buoyancy to permit flotation, supplemental buoyancy can be provided. At the installation site the end of the tether 12 which is to be secured to the foundation is rendered nonbuoyant by flooding, or by the addition of external weights, or by the removal of any buoyancy modules which were added to provide buoyancy during the tow. The tether 12 is then upended and the lower end is guided to the foundation latch. An ROV and work barge are used in this process. A buoyancy collar 83 is used to maintain the tether 12 in a vertical orientation following installation.

Once the tethers 12 are preinstalled and the hull 20 is complete, the hull 20 is towed to a position above the tethers 12. The tethers 12 are then secured to the hull 20 using the tether securing and tensioning systems 30 provided in the columns 18, as follows. Divers are used to secure tether positioning cables 84 from the upper end of each tether 12 to the lower end of the corresponding tether extender shroud 28. This serves to orient the tether 14 directly beneath the shroud 28 to facilitate tether engagement. The distance from the top of the tether 12 to the flex bearing 40 is then measured and the threaded load ring 54 is adjusted on the tether extender 22 to permit the tether extender 22 to be lowered and secured to the tether 12. The hoist 36 is then used to lower the tether extended 22 into the upper end of the tether 12 until the load ring 54 seats against the flex bearing 40. The tether extender latch 24 is then activated to lock the tether extender 22 to the tether 12. To permit the tether extender 22 to be lowered it may be necessary to pressurize the work chamber 70 to approximately the level of the hydrostatic pressure existing at the column bottom. Otherwise the hydrostatic force exerted on the tether extender 22 at the column bottom might exceed the weight of the tether extender 22, effectively locking it in the retracted position.

With the tether extender 22 secured to the tether 12, hydraulic pressure is applied to the tensioning cylinders 60 to drive the crosshead 58 and flex bearing adapter 42 upward until the desired initial level of tension is applied to the tether 12. The hydraulic pressure in the tensioning cylinders 60 is then locked off to maintain the tether extender 12 at a fixed axial position. This initial attachment and tensioning sequence is then repeated for the remaining tethers 12. Once this is accomplished, the hull 20 is deballasted to its working buoyancy. This added buoyancy increases the tension applied to the tethers 12. The tensioning system for each tether 12 is reactivated to bring the tension in each of the tethers 12 to a desired final level. The load studs 65 and load cells 68 are then seated against the load plate 64 to lock in the tether tension. The tensioning cylinders 60 may then be depressurized.

With the tethers 12 properly tensioned, the first removable access the section 80 is secured atop the tether extender 22 and the elliptical head 72 is fastened in place. The second removable access tube segment 82 is then secured between the elliptical head 72 and the access tube port in the hatch 75 in the ceiling of the work chamber 70. The work chamber 70 may be left unpressurized. In the event a leak should occur, the work chamber 70 can be pressurized to prevent the entry of sea water. Since the interior of the flex bearing adapter 42 is not a work area, it may be desirable to maintain it under pressure to prevent leakage in the event of a seal failure.

During the working life of the TLP it may be necessary to remove one or more of the tethers 12 for inspection, repair or replacement. This is accomplished by relieving the tension applied by the tether tensioning and securing system 30, attaching a buoyancy collar 83 to the top of the tether 12, releasing the tether latch 24 and retracting the tether extender 22 into the hull 20. Cables are attached from the top of the tether 12 to a workboat stationed adjacent to the TLP and are used to pull the upper end of the tether out from beneath the TLP hull 20. The tether base latch is then released and the tether 12 is brought to the ocean surface away from the TLP. Tether reinstallation is accomplished using the opposite procedure.

Alternative Embodiments

Figure 7:
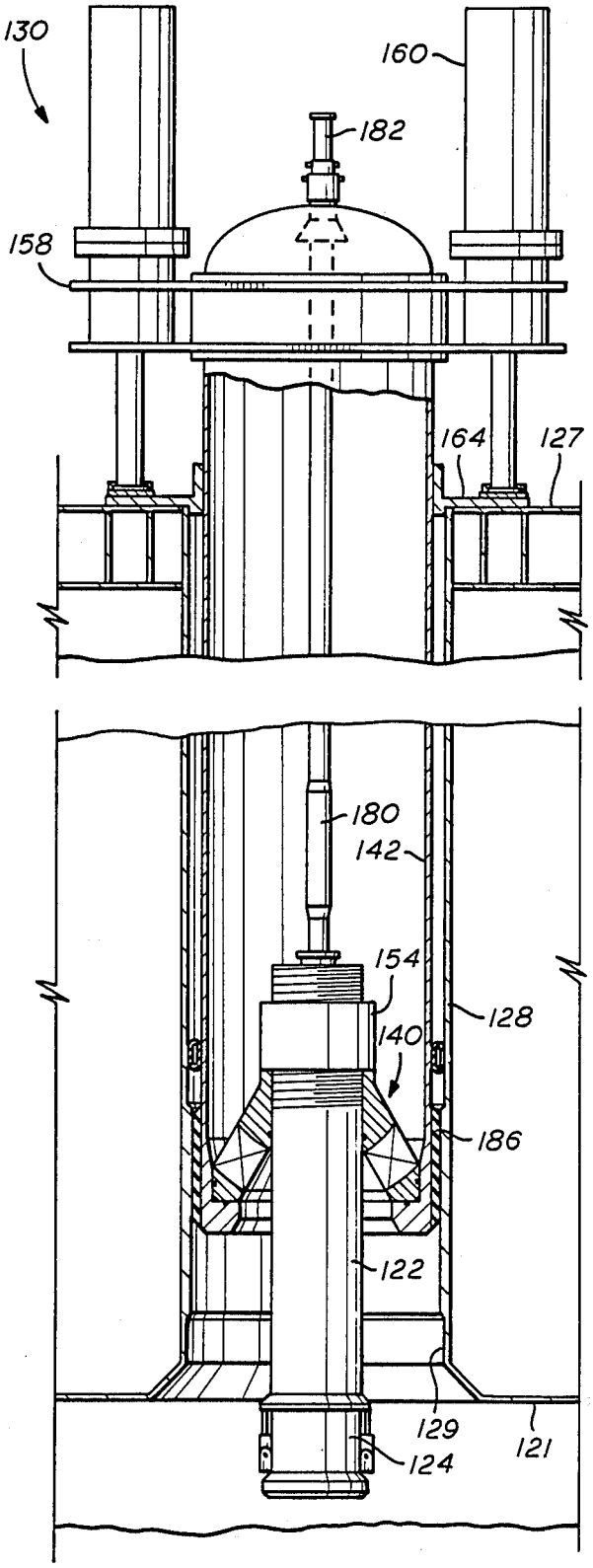
FIG. 7 is a view in elevational cross section of an alternate embodiment of the tether securing and tensioning system in which the tensioning system is supported on an above water mooring flat.

FIG. 7 illustrates an alternative embodiment of the tether securing and tensioning system 30 generally similar to that set forth above, but in which the mooring deck is positioned at an elevation above the water line. The principal advantages of this arrangement are that it eliminates the need for a pressurized work chamber at the column bottom and diminishes the importance of sealing the lower ends of the flex bearing adapter 142 and the tether extender 122 against seawater intrusion. In this embodiment the tether extender 122, the flex bearing 140 and the load ring 154 are identical to those of the embodiment shown in FIGS. 2–6. The crosshead 158, the tensioning cylinders 160, load plate 164, load studs 165 and load nuts 166 are also unchanged, but are located on a mooring deck 127 about 30 meters above the column bottom so as to be above water level. The tether extender shroud 128 and flex element adapter 142 are the only elements which differ significantly, being about 30 meters longer than those of the embodiment shown in FIGS. 2–6 to permit them to reach from the column bottom to the mooring deck 127.

This alternate design requires that a radial crossload bearing 186 be installed between the tether extender shroud 128 and the flex element adapter 142. The use of the radial crossload bearing 186 is required because the approximately 30 meter long flex element adapter 142 will undergo elongation of up to about 3cm over the range of loadings to which it will be subjected in operation of the tether securing and tensioning system 130. This could cause fretting on the contacting surfaces of the tether extender shroud 128 and flex element adapter 142 were they not separated by the radial crossload bearing 186. Use of a radial crossload bearing is not necessary in the embodiment shown in FIGS. 2–6 because the flex element adapter 42 of that embodiment is short enough that length changes during TLP operation will not result in significant fretting.

Figure 8:
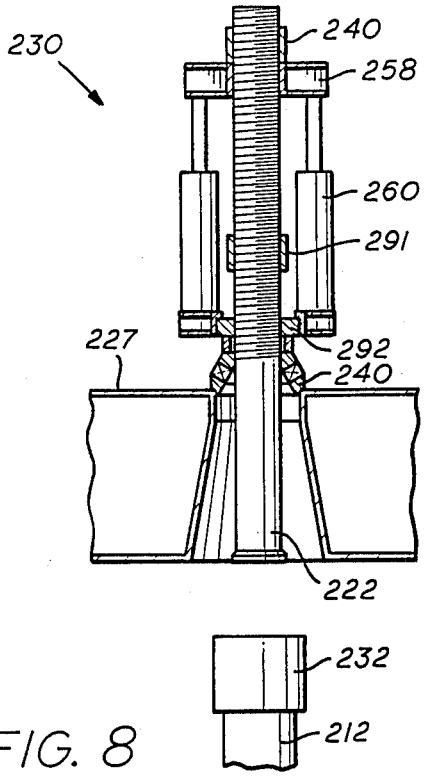
FIGS. 8–10 are views in elevational cross section of other alternate embodiments of the tether securing and tensioning system of the present invention.
Figure 9:
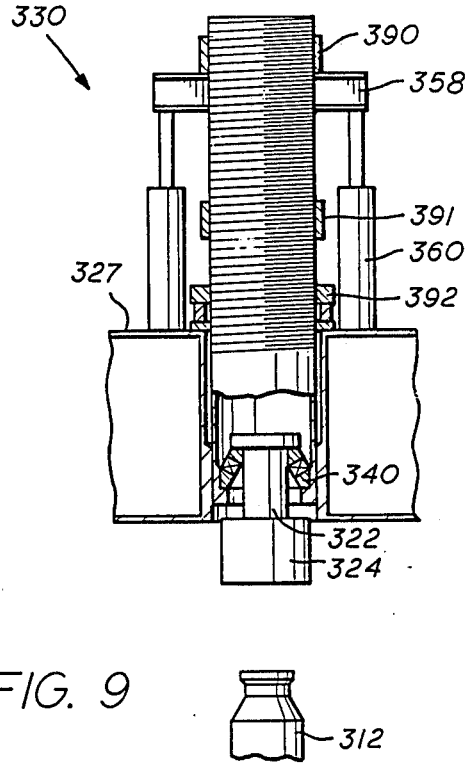
Figure 10:
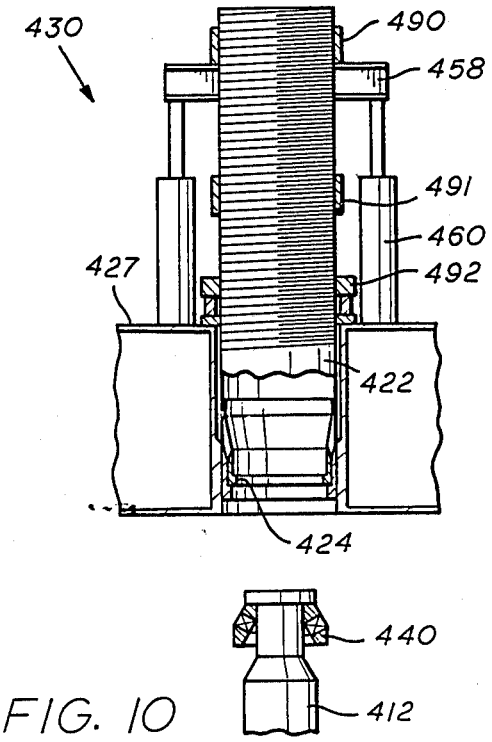

FIGS. 8–10 illustrate other alternate embodiments of the tether securing and tensioning system of the present invention. FIG. 8 illustrates an embodiment of the present tether securing and tensioning system 230 in which there is no flex bearing adapter. The flex bearing 240 is supported directly upon the mooring flat 227. Elements 290 and 291 are threaded rings used to limit downward extension of the tether extender 222 relative to the crosshead 258 and the load ring 292. The embodiment shown in FIG. 9 is generally similar to that of FIG. 8 but positions the flex bearing 340 at the interface between the tether extender 322 and the tether extender latch 324. The embodiment of FIG. 10 is similar to the embodiment shown in FIG. 9, but positions the flex bearing 440 at the upper end of the tether 412. A collet type tether extender latch 424 is used in this embodiment.

The preferred embodiment and alternative of the present invention described above all rely on the use of a tether securing and tensioning system in which a tether extender is provided for each tether. The tether extender bridges the vertical gap between the upper end of the tether and the hull to permit the tether to be secured to the hull. This vertical gap allows the tethers to be preinstalled to the ocean bottom foundation and the TLP hull to be subsequently positioned over the tethers without interference between the hull and tethers. More broadly, however, embodiments of the present invention are possible in which loads are transferred directly between the hull and the tethers, avoiding the need for tether extenders, while maintaining the existence of the initial vertical gap between the hull and the preinstalled tethers.

Figure 11:
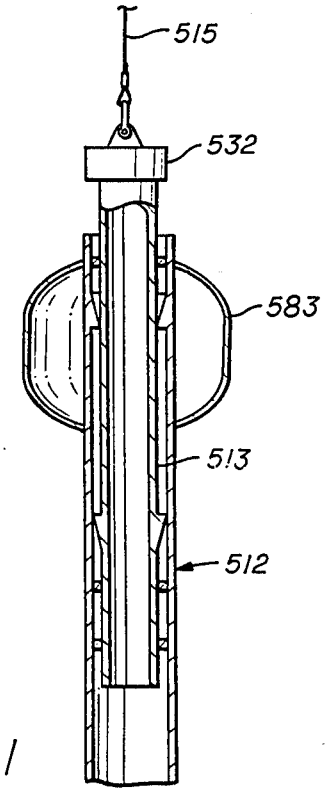
FIG. 11 is a view in elevational cross section of a tether incorporating a sliding extension at its upper end.

This can be accomplished, for example, by adapting the tethers so that after preinstallation and positioning of the TLP hull, the tethers can be raised into the bottom of the corresponding TLP hull column. This permits the tether to be secured and tensioned directly, eliminating the need for a tether extender. This may be achieved by providing the tether with a sliding base latch or a sliding extension in the tether itself to permit the tether to be pulled vertically upward into the column bottom after the hull is positioned over the preinstalled tethers. FIG. 11 illustrates a tether 512 having a sliding extension 513 at its upper end. Upon tether preinstallation the weight of the extension maintains it in a retracted position. After the hull is positioned over the tethers 512, a cable 515 is attached to the upper end of the tether 512 and the tether is pulled upward into the column bottom as the sliding extension 513 assumes its extended position. Means are provided within the column for securing the sliding extension 513 and biasing it upward, thereby tensioning the tether 512.

In the various embodiments described above, once the tethers 12 are secured to the hull 20 they are tensioned by lifting them relative to the TLP mooring deck 27 and then locking them in position. This forces the buoyant hull 20 to assume a deeper draft than would be the case were the hull 20 unrestrained. The buoyant force of the hull 20 maintains the tethers in tension. It is possible to eliminate the need for any special equipment for applying the initial tension load to the tethers 12 if the hull 20 is ballastable. In such an embodiment, the hull 20 would be positioned over the preinstalled tethers 12 and fully ballasted. In the ballasted condition as well as the unballasted condition a vertical gap would exist between the hull bottom 21 and the top of the tethers 12. The tethers 12 would then be secured to the hull 20 using tether extenders 22 or extensible tethers are detailed above. The hull 20 would then be deballasted until the desired tension load was applied to the tethers 12.

The TLP installation methods described previously all require preinstallation of the tethers. It is, however, possible to install the tethers 12 and hull 20 simultaneously using the tether securing and tensioning system 30 of the present invention. In this method the hull 20 would be towed to the installation site and maintained in position using thrusters or workboats. The tether 12 would be brought on site or assembled on site as detailed previously. Each tether 12 would be lowered adjacent to the TLP hull 20 and latched to the foundation 14 using an ROV. The lowering operation could be conducted from a workboat or from the hull 20 itself. During lowering, the upper end of the tether 12 would be maintained a short distance away from the hull 20. After the tether bottom is secured to the foundation 14 the tether 12 would be swung into position beneath the corresponding one of the tether securing and tensioning systems using guide cables 84. The remainder of the installation procedure corresponds to that used for preinstalled tethers, as described above.

The preferred embodiments of the tether securing and tensioning system and corresponding TLP installation method of the present invention have been set forth above. Those skilled in the art will readily appreciate that there will be numerous alternative embodiments of the equipment and installation method all based on the general principles disclosed above. Accordingly, it should be understood that the foregoing description is illustrative only, and that other apparatus and methods can be employed without departing from the full scope of the present invention as set forth in the appended claims.

I claim:

1. A tension leg platform, comprising:

a foundation element secured to an ocean bottom location;

a plurality of elongate, substantially vertical tethers, each of said tethers having a lower end secured to said foundation element and an upper end which reaches a position a preselected vertical distance below the ocean surface;

a buoyant hull positioned at the ocean surface above said tethers, said hull having a free floating draft which is less than said preselected vertical distance, whereby said tethers can be preinstalled and said hull can subsequently be positioned over said tethers without interference between said tethers and said hull, said hull defining a plurality of recesses extending vertically upward into said hull from a lower surface of said hull;

a plurality of rigid tether extenders, each positioned within a corresponding one of said recesses;

means for controllably fixing the vertical position of each tether extender within the corresponding one of said recesses; and means for connecting and disconnecting each tether extender to the corresponding one of said tethers while said corresponding tether is secured to said foundation element.

2. The tension leg platform as set forth in claim 1 wherein said tether extender has a connector at its lower end, said connector being adapted to be releasably secured to the upper end of a corresponding tether.

3. The tension leg platform, as set forth in claim 1, wherein said tether extenders define conduits permitting tools to be passed from said tension leg platform hull into a selected tether through the corresponding tether extender.

4. The tension leg platform, as set forth in claim 1, further comprising means for preventing seawater from rising past the location of the tether extender in each recess, said tether extenders being situated wholely below the waterline of said buoyant hull.

5. A tension leg platform, comprising:

a foundation element secured at an ocean bottom location;

a buoyant hull positioned at the ocean surface above said foundation element;

a plurality of elongate, substantially vertical tethers, each of said tethers having a lower end secured to said foundation element and an upper end positioned a spaced distance below the bottom of said hull;

a plurality of rigid tether extenders, each of said tether extenders having a lower end releaseably secured to the upper end of a corresponding one of said tethers and an upper end extending into said hull;

a flex bearing supporting each tether extender within said hull whereby said tether extender can pivot relative to said hull to accommodate lateral movement of said hull relative to said foundation element; and means for biasing said tether extenders upward relative to said hull, whereby each tether extender and corresponding tether are placed in tension.

6. The tension leg platform as set forth in claim 5 wherein the length of said tethers is selected to ensure that the upper ends of said tethers remain at an elevation below the bottom of said hull throughout operation of said tension leg platform.

7. The tension leg platform as set forth in claim 5 wherein said tether extenders are elongate elements having a substantially vertical longitudinal axis, said tension leg platform further including means for moving each of said tether extenders between a first position in which said tether extender is wholly within said hull and a second position in which said tether extender extends downward below said hull to the elevation of the upper end of the corresponding one of said tethers.

8. The tension leg platform as set forth in claim 5 wherein each of said flex bearings is supported within a flex bearing adapter, and wherein said biasing means is means for controllably biasing each flex bearing adapter upward.

9. A tension leg platform hull adapted to be secured to a set of tethers which extend upward from the ocean bottom, said tethers each having an upper end situated a preselected depth below the ocean surface, said preselected depth being greater than the draft of said hull, said hull comprising:

a work deck;

a buoyant hull structure supporting said work deck above the ocean surface;

a plurality of shrouds extending upward into said buoyant hull structure from a lower surface of said buoyant hull structure to define recesses in the bottom of said buoyant hull structure;

a plurality of rigid tether extenders, each being positioned within a corresponding one of said shrouds, said tether extenders each having a lower end with a latch element secured thereto, each latch element being adapted to attach and detach said tether extender to the upper end of a corresponding one of said tethers while said tether upper end is situated below said hull;

means for lowering each of said tether extenders downward relative to said hull structure from a position within the corresponding shroud to a position in which said tether extender projects below the lower surface of said buoyant hull structure, whereby said tether extenders can each be lowered to reach and be secured to the upper end of a corresponding one of said tethers; and means for biasing each of said tether extenders upward relative to said buoyant hull structure, whereby once a tether extender is secured to the corresponding one of said tethers, said tether extender may be biased upward to tension said tether.

10. The tension leg platform, as set forth in claim 9, wherein each of said tether extenders is supported within said shroud by a flex bearing.

11. The tension leg platform, as set forth in claim 9 wherein each tether extender is an elongate element having a substantially vertical longitudinal axis, said tension leg platform further including:

a tubular element supported within each of said shrouds; and a flex bearing supported within each of said tubular elements, said flex bearing supporting a corresponding one of said tether extenders.

12. The tension leg platform, as set forth in claim 11 wherein said biasing means is adapted to controllably bias said tubular elements upward relative to the buoyant hull structure.

13. A tension leg platform adapted for installation at a preselected ocean location, comprising:

a buoyant hull, said hull including a plurality of columns, each of said columns having a lower end situated below the ocean surface, said columns extending upward to a position above the ocean surface;

a work deck secured to said columns;

a plurality of vertically extending shrouds secured within at least some of said columns, said shrouds each defining an aperture in the lower end of the corresponding column and also defining a recess extending vertically upward from said aperture;

a plurality of sleeves, each of said sleeves being positioned within a corresponding one of said shrouds;

means for supporting each sleeve within said corresponding shroud and for controllably moving said sleeve upward within said corresponding shroud;

a plurality of rigid tether extenders, each tether extender being positioned within a corresponding one of said sleeves and being adapted to be adjusted vertically within said sleeve from a lower position in which said tether extender projects below the lower end of the corresponding column to an upper position in which said tether extender is raised upward from said lower position;

a foundation element at the ocean bottom;

a plurality of elongate, substantially vertical tethers each having a lower end secured to said foundation element and an upper end positioned a spaced distance below said lower ends of said columns; and means for releaseably securing each tether extender to said upper end of a corresponding one of said tethers after said corresponding tether has first been secured to said ocean bottom, whereby said tethers can first be secured to said foundation element, and said hull and work deck assembly can subsequently be positioned over said tethers and said tether extenders can each be lowered and releaseably secured to a corresponding one of said tethers.

14. The tension leg platform as set forth in claim 13 wherein each of said tether extenders is supported within the corresponding one of said sleeves by a flex bearing, whereby the longitudinal axis of each tether extender may pivot relative to the longitudinal axis of said corresponding sleeve.

15. A method for installing a tension leg platform at an offshore location, said method comprising the steps of:

a. establishing a foundation for said tension leg platform on the ocean floor at said offshore location;

b. securing a plurality of tethers in substantially vertical orientation to said foundation, said tethers each having a lower end secured to said foundation and an upper end situated at an elevation a spaced distance below the ocean surface;

c. positioning a tension leg platform hull above said foundation and tethers, said tension leg platform hull having a draft which is less than the distance from said ocean surface to the upper ends of said tethers, whereby clearance exists between the upper ends of said tethers and the bottom of said hull;

d. lowering a rigid tether extender from within said hull to the upper end of a corresponding one of said tethers;

e. securing said tether extender to the upper end of a corresponding one of said tethers;

f. applying an upward force to said tether extender from within said hull whereby the corresponding tether is placed in tension; and g. repeating steps d-f for others of said tethers.

16. The method as set forth in claim 9 further including the step of locking the vertical position of said tether extender within said hull whereby said tether is maintained under tensile loading during operation of said tension leg platform through the upward force applied by said tether extender.

17. A tension leg platform hull adapted to be moored at a selected ocean location by a plurality of tubular tethers anchored to an ocean bottom foundation and extending upward to a position a spaced distance below the ocean surface, said hull comprising:

a work deck;

a buoyant hull structure supporting said work deck above the ocean surface, said buoyant hull structure defining a plurality of recesses extending upward into said buoyant hull structure from a lower surface of said buoyant hull structure;

a plurality of rigid tether extenders, each being positioned within a corresponding one of said recesses;

means for lowering each of said tether extenders downward relative to said buoyant hull structure from a position within said recess to a position in which at least a portion of said tether extenders projects below the lower surface of said buoyant hull structure;

a plurality of connectors, each being secured to the lower end of a corresponding one of said tether extenders, said connectors being adapted to releaseably secure the corresponding tether extender to one of said tethers;

a plurality of flex bearings, each supporting said tether extenders within the corresponding aperture, said flex bearings being adapted to permit said tether extenders to pivot relative to said buoyant hull structure, said flex bearings being located below the waterline of said buoyant hull structure; and means for preventing seawater from rising above the location of the flex bearing within each of said recesses.

18. The tension leg platform hull, as set forth in claim 17, wherein said tether extenders define conduits permitting tools to be passed from said tension leg platform hull into a selected tether through the corresponding tether extender.

19. A tension leg platform comprising:

a foundation element at an ocean bottom location;

a buoyant hull positioned at the ocean surface above said foundation element, said hull extending a preselected distance below the ocean surface when said hull is free floating and deballasted;

a plurality of tethers, each of said tethers having a lower end secured to said foundation element and an upper end positioned at a depth greater than said preselected distance when said tether is free from connection to said hull, whereby said tethers can be secured to said foundation element and permitted to extend vertically upward, and said hull can be positioned above said tethers without said tethers contacting said hull;

a plurality of rigid tether extenders, each being secured to said hull and having a lower end with a latch element secured thereto, each latch element being adapted to secure said tether extender to a corresponding one of said tethers while said tether upper end is situated below said hull; and means for lowering each of said tether extenders downward relative to said hull to a position in which said tether extender projects below the lower surface of said hull, whereby said tether extenders can each be lowered to reach and be secured to the upper end of a corresponding one of said tethers.

20. The tension leg platform as set forth in claim 19 further including means for connecting and disconnecting each tether extender to the corresponding one of said tethers while said corresponding tether is secured to said foundation element.

21. The tension leg platform as set forth in claim 19 wherein said tethers each include a sliding extension adapted to permit the length of each tether to be extended a distance sufficient to bridge the gap between said preselected vertical distance and said fully ballasted draft of said hull.

22. The tension leg platform as set forth in claim 19 wherein said tethers are each secured to said foundation element by a sliding base latch adapted to permit said tethers to be pulled upward a spaced distance relative to said foundation element, whereby the upper end of each tether may be pulled upward into said hull subsequent to positioning said hull over said tethers.

23. A method for installing a tension leg platform at an offshore location, said method comprising the steps of:

a. establishing a foundation for said tension leg platform on the ocean floor at said selected offshore location;

b. positioning a tension leg platform hull above said foundation, said hull having a preselected initial draft;

c. lowering a tether downward to the foundation from a position adjacent and exterior to said hull, said tether having a total height less than the distance from said foundation to the bottom of said hull;

d. securing the lower end of said tether to said foundation;

e. swinging the upper end of said tether to a position below said hull;

f. lowering a rigid tether extender from said hull to the upper end of said tether;

g. securing said tether extender to the upper end of said tether;

h. applying an upward force to said tether extender, whereby said tether is placed in tension; and i. repeating steps c-h for additional tethers.

24. The method as set forth in claim 23 wherein said tethers are lowered from the hull.

25. The method as set forth in claim 23 wherein said tethers are lowered from a work vessel adjacent said hull.

* * * * *